US009181951B2

(12) United States Patent
Tozawa et al.

(10) Patent No.: US 9,181,951 B2
(45) Date of Patent: Nov. 10, 2015

(54) SCROLL COMPRESSOR

(71) Applicant: KABUSHIKI KAISHA TOYOTA JIDOSHOKKI, Kariya-shi, Aichi-ken (JP)

(72) Inventors: Kosaku Tozawa, Kariya (JP); Ken Suitou, Kariya (JP)

(73) Assignee: KABUSHIKI KAISHA TOYOTA JIDOSHOKKI, Aichi (TW)

( * ) Notice: Subject to any disclaimer, the term of this patent is extended or adjusted under 35 U.S.C. 154(b) by 173 days.

(21) Appl. No.: 14/076,644

(22) Filed: Nov. 11, 2013

(65) Prior Publication Data

US 2014/0134032 A1 May 15, 2014

(30) Foreign Application Priority Data

Nov. 13, 2012 (JP) ..... 2012-249185

(51) Int. Cl.

| | |
|---|---|
| ***F04C 28/22*** | (2006.01) |
| ***F01C 17/06*** | (2006.01) |
| ***F04C 28/08*** | (2006.01) |
| ***F04C 18/02*** | (2006.01) |
| *F04C 27/00* | (2006.01) |

(52) U.S. Cl.

CPC ..... *F04C 28/22* (2013.01); *F01C 17/06* (2013.01); *F04C 18/0215* (2013.01); *F04C 18/0261* (2013.01); *F04C 28/08* (2013.01); *F04C 27/001* (2013.01); *F04C 2270/13* (2013.01)

(58) Field of Classification Search

CPC .. F04C 18/0215; F04C 23/008; F04C 27/001; F04C 27/005; F04C 27/007; F04C 28/22; F04C 29/005; F04C 29/0057

USPC ..... 418/55.3, 55.5, 57, 55.2

See application file for complete search history.

(56) References Cited

U.S. PATENT DOCUMENTS

| | | | | | |
|---|---|---|---|---|---|
| 4,575,318 | A | * | 3/1986 | Blain | 418/14 |
| 5,040,958 | A | * | 8/1991 | Arata et al. | 418/55.5 |
| 5,520,524 | A | * | 5/1996 | Takemoto et al. | 418/14 |
| 5,681,155 | A | * | 10/1997 | Hisanaga et al. | 418/14 |
| 5,803,722 | A | * | 9/1998 | Noboru et al. | 418/55.5 |
| 6,089,840 | A | * | 7/2000 | Iizuka et al. | 418/55.5 |
| 6,123,527 | A | * | 9/2000 | Kawada et al. | 418/55.1 |
| 6,280,165 | B1 | * | 8/2001 | Tsuchiya et al. | 418/55.1 |

(Continued)

FOREIGN PATENT DOCUMENTS

| | | | |
|---|---|---|---|
| CN | 1441167 | A | 9/2003 |
| JP | 7-293466 | A | 11/1995 |

(Continued)

*Primary Examiner* — Charles Freay
*Assistant Examiner* — Nathan Zollinger
(74) *Attorney, Agent, or Firm* — Sughrue Mion, PLLC

(57) ABSTRACT

A scroll compressor includes a rotation shaft, a fixed scroll, a movable scroll, a compression chamber, and a shaft support. A movable member is movable in an axial direction of the rotation shaft toward and away from the movable scroll. A rotation restriction mechanism includes a pin and a hole that is loosely fitted into the hole. An orbital radius switching mechanism moves the movable member in a first direction when a rotation speed of the rotation shaft is increased, which decreases an orbital radius of the pin relative to the hole so that an orbital radius of the movable scroll is decreased, and moves the movable member in a second direction when the rotation speed of the rotation shaft is decreased, which increases the orbital radius of the pin relative to the hole so that the orbital radius of the movable scroll is increased.

7 Claims, 5 Drawing Sheets

(56) References Cited

U.S. PATENT DOCUMENTS

| | | | | |
|---|---|---|---|---|
| 6,589,035 | B1 | 7/2003 | Tsubono et al. | |
| 6,742,996 | B2 | 6/2004 | Ueda et al. | |
| 8,202,071 | B2 | 6/2012 | Kii et al. | |
| 8,360,742 | B2 | 1/2013 | Kimoto et al. | |
| 2002/0081224 | A1* | 6/2002 | Ueda et al. | 418/55.5 |
| 2003/0190247 | A1 | 10/2003 | Tsubono et al. | |
| 2004/0247476 | A1 | 12/2004 | Tsubono et al. | |
| 2006/0051226 | A1 | 3/2006 | Tsubono et al. | |
| 2006/0057010 | A1 | 3/2006 | Tsubono et al. | |
| 2014/0134033 | A1* | 5/2014 | Tozawa et al. | 418/55.3 |

FOREIGN PATENT DOCUMENTS

| | | | |
|---|---|---|---|
| JP | 8-144969 | A | 6/1996 |
| JP | 10-205466 | A | 8/1998 |
| JP | 10-281084 | A | 10/1998 |
| JP | 10306785 | A | 11/1998 |
| JP | 11294349 | A | 10/1999 |
| JP | 2002-195176 | A | 7/2002 |
| JP | 2005315167 | A | 11/2005 |
| JP | 2009-209682 | A | 9/2009 |
| JP | 2009287481 | A | 12/2009 |
| JP | 2010-14108 | A | 1/2010 |

* cited by examiner

SCROLL COMPRESSOR

BACKGROUND OF THE INVENTION

The present invention relates to a scroll compressor.

Generally, a scroll compressor includes a fixed scroll, which is fixed to a housing, and a movable scroll, which orbits with respect to the fixed scroll. The fixed scroll includes a fixed base plate and a fixed spiral wall projecting from the fixed base plate. The movable scroll includes a movable base plate and a movable spiral wall projecting from the movable base plate. The fixed spiral wall and the movable spiral wall are engaged with each other to define a compression chamber. The orbital movement of the movable scroll decreases the volume of the compression chamber and compresses refrigerant. Japanese Laid-Open Patent Publication No. 2010-14108 describes an example of such a scroll compressor.

In the scroll compressor, a large centrifugal force acts on the movable scroll especially when the rotation shaft rotates at a high speed. This increases the noise generated when the movable spiral comes into contact with the fixed spiral wall. When the movable spiral wall is spaced apart from the fixed spiral wall to avoid contact between the spiral walls, leakage of the refrigerant from the compression chamber increases when the rotation shaft rotates at a low speed. This lowers the compression performance.

SUMMARY OF THE INVENTION

It is an object of the present disclosure to provide a scroll compressor that can reduce noise caused by contact between the fixed spiral wall and the movable spiral wall when the rotation shaft rotates at a high speed and reduce leakage of refrigerant from the compression chamber when the rotation shaft rotates at a low speed.

To achieve the above object, one aspect of the present invention is a scroll compressor that includes a rotation shaft, a fixed scroll including a fixed spiral wall, and a movable scroll including a movable spiral wall engaged with the fixed spiral wall. The movable scroll orbits when the rotation shaft is rotated. A compression chamber is defined between the fixed spiral wall and the movable spiral wall. The compression chamber has a volume that is decreased when the movable scroll orbits, and refrigerant is compressed in the compression chamber when the volume is decreased. A shaft support supports the rotation shaft. The shaft support and the fixed scroll are arranged at opposite sides of the movable scroll. A housing accommodates the rotation shaft, the fixed scroll, the movable scroll, and the shaft support. A movable member is arranged in the shaft support and configured to be movable in an axial direction of the rotation shaft toward and away from the movable scroll. A rotation restriction mechanism is configured to restrict rotation of the movable scroll. The rotation restriction mechanism includes a cylindrical pin, which is arranged in one of the movable scroll and the movable member, and a circular hole, which is arranged in the other of the movable scroll and the movable member. The cylindrical pin is loosely fitted into the circular hole, and at least one of the cylindrical pin and the circular hole includes a small diameter portion and a large diameter portion. An orbital radius switching mechanism is configured to move the movable member in a first direction along an axis of the rotation shaft when a rotation speed of the rotation shaft is increased, which decreases an orbital radius of the cylindrical pin relative to the circular hole so that an orbital radius of the movable scroll is decreased, and configured to move the movable member in a second direction, which is opposite to the first direction, when the rotation speed of the rotation shaft is decreased, which increases the orbital radius of the cylindrical pin relative to the circular hole so that the orbital radius of the movable scroll is increased.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE INVENTION

First Embodiment

Figure 1:
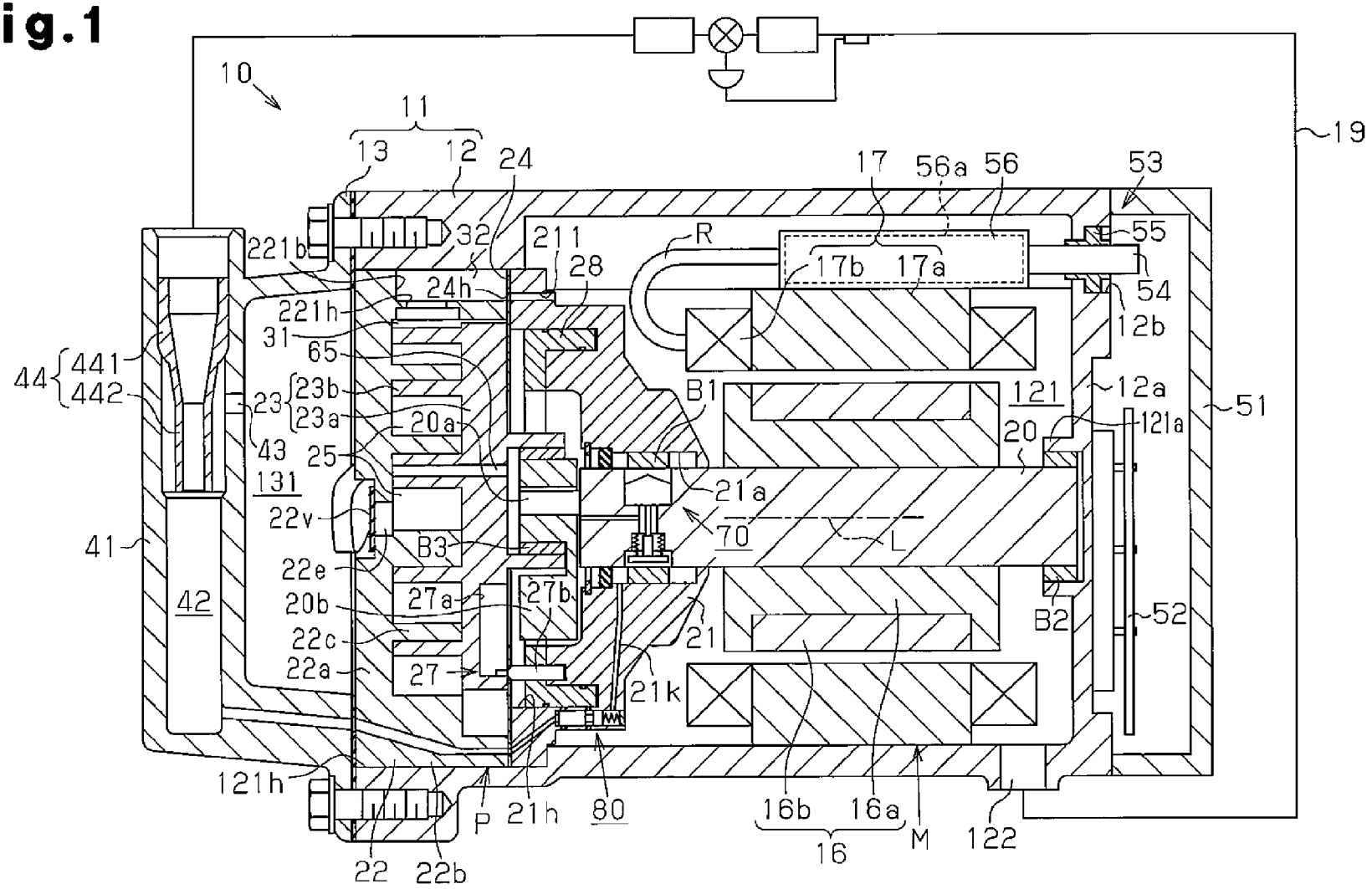
FIG. 1 is a cross-sectional view showing a scroll compressor of a first embodiment.
Figure 2:
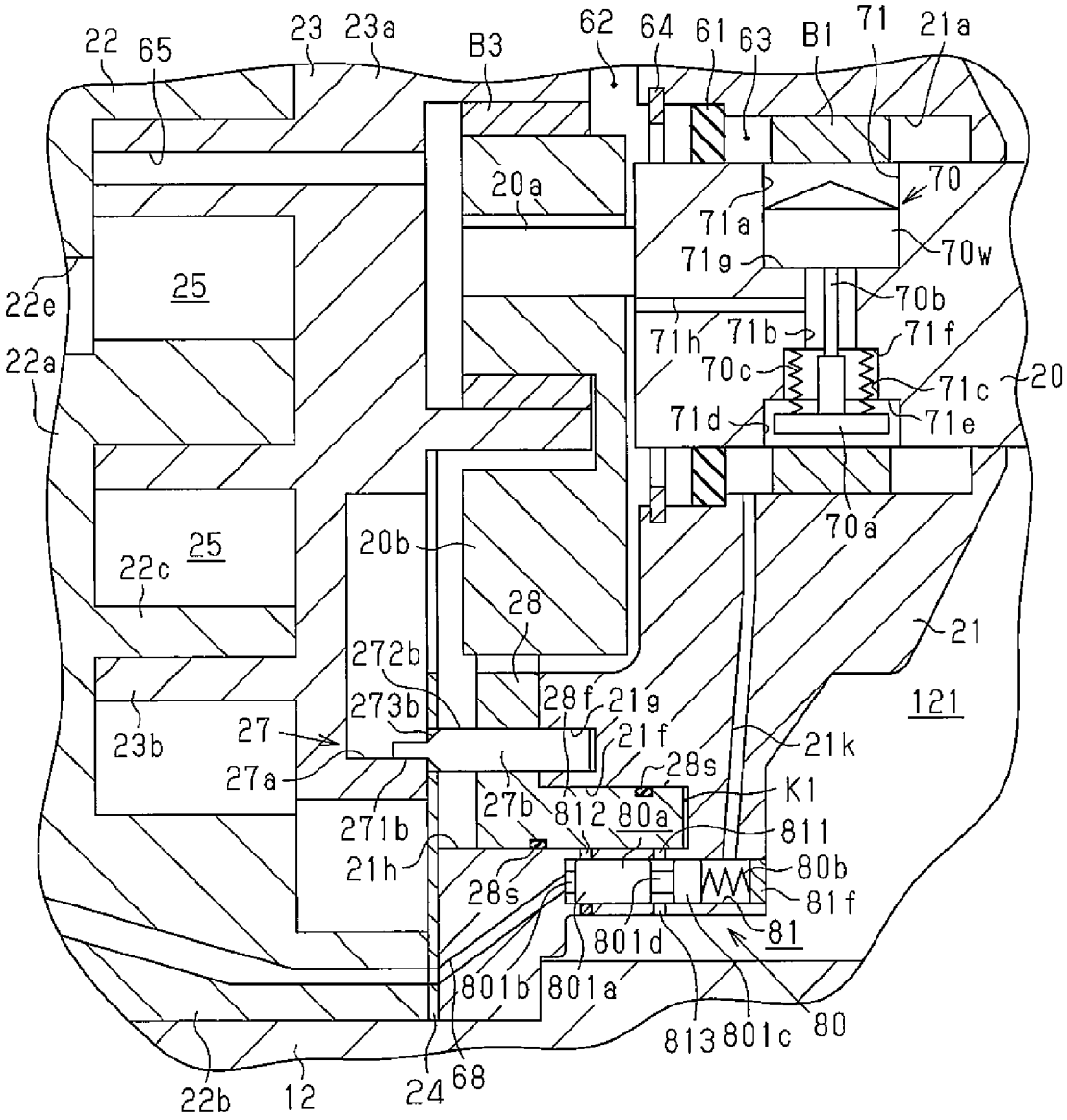
FIG. 2 is an enlarged cross-sectional view showing a rotation restriction mechanism in the scroll compressor of FIG. 1.
Figure 3:
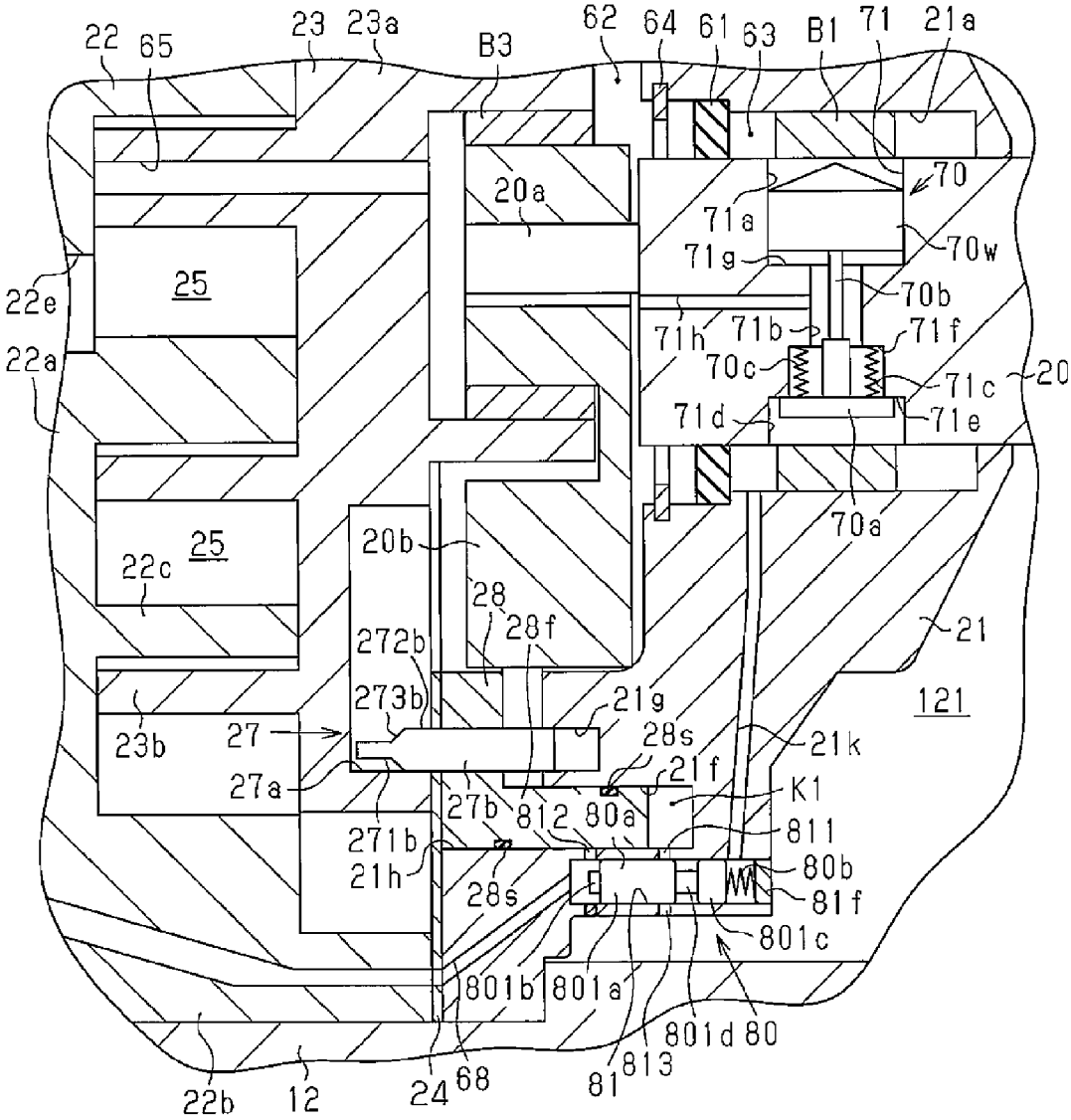
FIG. 3 is an enlarged cross-sectional view showing the rotation restriction mechanism in the scroll compressor of FIG. 1.

Referring to FIGS. 1 to 3, a first embodiment of a scroll compressor (hereinafter referred to as the compressor) will now be described. The compressor is installed in a vehicle and used with a vehicle air-conditioning device.

As shown in FIG. 1, the compressor 10 includes a housing 11 made of metal (aluminum in the present embodiment). The housing 11 includes a cylindrical motor housing member 12 and a cylindrical discharge housing member 13. The motor housing member 12 includes a closed end and an open end 121*h* (left end as viewed in FIG. 1). The discharge housing member 13, which has a closed end, is connected to the open end 121*h* of the motor housing member 12. The motor housing member 12 accommodates a compression unit P, which compresses refrigerant, and an electric motor M, which drives the compression unit P.

The motor housing member 12 includes an end wall 12*a* and a cylindrical shaft support portion 121*a* projecting from the central section of the end wall 12*a*. A shaft support 21 is fixed in the motor housing member 12 near the open end 121*h*. An insertion hole 21*a* extends through a central section of the shaft support 21. The motor housing member 12 also accommodates a rotation shaft 20. The rotation shaft 20 includes two ends. One end, which faces toward the open end 121*h* of the motor housing member 12, is located in the insertion hole 21*a* of the shaft support 21 and supported by a bearing B1 to be rotatable relative to the shaft support 21. The other end of the rotation shaft 20 faces toward the end wall 12*a* of the motor housing member 12 and is supported by a bearing B2 to be rotatable relative to the shaft support portion 121*a*. The bearings B1 and B2 are plain bearings.

The motor housing member 12 includes a motor chamber 121 extending between the shaft support 21 and the end wall 12*a*. The motor chamber 121 accommodates the electric motor M that includes a rotor 16, which rotates integrally with the rotation shaft 20, and a stator 17, which surrounds the rotor 16 and is fixed to the inner surface of the motor housing member 12. The rotor 16 includes a rotor core 16*a*, which is fixed to the rotation shaft 20 and rotated integrally with the rotation shaft 20, and a plurality of permanent magnets 16*b*, which are embedded in the rotor core 16*a*. The stator 17 includes a stator core 17*a*, which is annular and fixed to the inner surface of the motor housing member 12, and coils 17*b*, which are wound around the teeth (not shown) of the stator core 17*a*. Leads R for U, V, and W phases (only one lead shown in FIG. 1) extend from the ends of the coils 17*b* that face toward the shaft support 21.

A fixed scroll 22 is arranged between the shaft support 21 and the open end 121*h* of the motor housing member 12. The fixed scroll 22 includes a circular base plate 22*a*, a cylindrically-formed peripheral wall 22*b* projecting from the periphery of the base plate 22*a*, and a fixed spiral wall 22*c* projecting from the base plate 22*a* at the inner side of the peripheral wall 22*b*. An annular flat plate 24 is arranged between the fixed scroll 22 and the shaft support 21. The plate 24 functions as a spring and is formed from a metal material such as a carbon tool steel. The plate 24 seals the gap between the fixed scroll 22 and the shaft support 21. The fixed scroll 22 faces the shaft support 21 and the plate 24 and is fitted into and fixed to the motor housing member 12.

An eccentric shaft 20*a* projects from the end face of the rotation shaft 20 that faces toward the open end 121*h*. The eccentric shaft 20*a* is eccentric to the rotation axis L of the rotation shaft 20. The eccentric shaft 20*a* supports a bushing 20*b*. A movable scroll 23 is supported by the bushing 20*b* to be rotatable relative to the bushing 20*b*. A bearing B3 is arranged between the movable scroll 23 and the bushing 20*b*. The movable scroll 23 includes a circular base plate 23*a* and a movable spiral wall 23*b* projecting from the base plate 23*a* toward the base plate 22*a* of the fixed scroll 22.

The movable scroll 23 is arranged between the shaft support 21 and the fixed scroll 22. The movable scroll 23 is supported in a manner allowing for the movable scroll 23 to orbit with respect to the fixed scroll 22. Thus, the shaft support 21 and the fixed scroll 22 are located at opposite sides of the movable scroll 23 in the motor housing member 12. The fixed spiral wall 22*c* of the fixed scroll 22 and the movable spiral wall 23*b* of the movable scroll 23 are engaged with each other. The fixed spiral wall 22*c* has a distal surface in contact with the base plate 23*a* of the movable scroll 23. The movable spiral wall 23*b* has a distal surface in contact with the base plate 22*a* of the fixed scroll 22. The base plate 22*a* and the fixed spiral wall 22*c* of the fixed scroll 22 and the base plate 23*a* and the movable spiral wall 23*b* of the movable scroll 23 define a compression chamber 25.

A rotation restriction mechanism 27 is arranged between the base plate 23*a* of the movable scroll 23 and the shaft support 21. The rotation restriction mechanism 27 includes a plurality of circular holes 27*a*, which are arranged in the outer circumferential portion of the end surface of the base plate 23*a* of the movable scroll 23, and a plurality of cylindrical pins 27*b* (only one shown in FIG. 1), which project from the outer circumferential portion of the shaft support 21 and are loosely fitted into the circular holes 27*a*.

As shown in FIG. 2, the end surface of the shaft support 21 that faces the movable scroll 23 includes an accommodating recess 21*h*. The accommodating recess 21*h* has an end surface including an annular groove 21*f* extending in the axial direction of the rotation shaft 20. In addition, insertion holes 21*g* are arranged in the end surface of the accommodating recess 21*h* at the radially inner side of the annular groove 21*f*. The cylindrical pins 27*b* are insertable into the insertion holes 21*g*, respectively.

The accommodating recess 21*h* accommodates an annular movable member 28 surrounding the bushing 20*b*. The movable member 28 is movable in the axial direction of the rotation shaft 20. The movable member 28 includes an end surface facing toward the shaft support 21 and an annular flange 28*f* projecting from the periphery of the end surface in the axial direction of the rotation shaft 20. The inner and outer surfaces of the annular flange 28*f* each include an annular sealing member 28*s*. The sealing members 28*s* seal a pressure-acting void K1, which is located toward the end wall 12*a* of the motor housing member 12 in the annular groove 21*f*, from the accommodating recess 21*h*. The pressure-acting void K1 is formed between the movable member 28 and the shaft support 21. The cylindrical pins 27*b* are inserted into and integrated with the movable member 28.

Each of the cylindrical pins 27*b* includes a small diameter portion 271*b*, a large diameter portion 272*b*, which has a larger diameter than the small diameter portion 271*b*, and a step portion 273*b* arranged between the small diameter portion 271*b* and the large diameter portion 272*b*. The step portion 273*b* extends linearly and is diagonal in the cross section to the axis of the cylindrical pin 27*b* so as to form a part of conical surface.

As shown in FIG. 1, when the rotation shaft 20 is driven by the electric motor M and rotated, the movable scroll 23, which is coupled to the rotation shaft 20 by the eccentric shaft 20*a*, orbits about the axis of the fixed scroll 22 (the rotation axis L of the rotation shaft 20) without rotating. The rotation restriction mechanism 27 prevents rotation of the movable scroll 23 while permitting the orbital motion. The orbital motion of the movable scroll 23 reduces the volume of the compression chamber 25. Thus, the fixed scroll 22 and the movable scroll 23 form a compression unit P that draws in and discharges refrigerant.

The peripheral wall 22*b* of the fixed scroll 22 and the outermost portion in the movable spiral wall 23*b* of the movable scroll 23 define a suction chamber 31 that is in communication with the compression chamber 25. The peripheral wall 22*b* of the fixed scroll 22 has an outer surface including a recess 221*b*. The area surrounded by the recess 221*b* and the inner surface of the motor housing member 12 forms a suction passage 32 that is connected to the suction chamber 31 through a through hole 221*h* in the peripheral wall 22*b* of the fixed scroll 22. A through hole 211, which extends through the peripheral portion of the shaft support 21, and a through hole 24*h*, which extends through the peripheral portion of the plate 24, connect the suction passage 32 to the motor chamber 121.

The motor housing member 12 includes a suction port 122 connected to an external refrigerant circuit 19. Refrigerant (gas) is drawn into the motor chamber 121 from the external refrigerant circuit 19 through the suction port 122. The refrigerant in the motor chamber 121 is then sent to the compression chamber 25 through the through hole 211, the through hole 24*h*, the suction passage 32, the through hole 221*h*, and the suction chamber 31. Accordingly, the motor chamber 121, the through hole 211, the through hole 24*h*, the suction passage 32, the through hole 221*h*, and the suction chamber 31 form a suction pressure region.

The refrigerant in the compression chamber 25 is compressed by the orbiting motion (discharging motion) of the movable scroll 23 and discharged into a discharge chamber 131 of the discharge housing member 13 through a discharge port 22*e* by pushing a discharge valve 22*v* away.

A chamber-forming wall 41 is formed integrally with the discharge housing member 13. An oil-separating chamber 42 is formed between the discharge housing member 13 and the chamber-forming wall 41. The oil-separating chamber 42 is in communication with the discharge chamber 131 through a discharge port 43 formed in the discharge housing member 13. The refrigerant in the discharge chamber 131 is sent to the oil-separating chamber 42 through the discharge port 43.

The oil-separating chamber 42 accommodates an oil-separating tube 44. The oil-separating tube 44 includes a large diameter portion 441, which is fitted in the oil-separating chamber 42, and a small diameter portion 442, which has a smaller diameter than the oil-separating chamber 42 and is located under the large diameter portion 441. Refrigerant flows into the oil-separating chamber 42 through the discharge port 43, swirls around the small diameter portion 442, and then flows into the oil-separating tube 44 from a lower opening in the small diameter portion 442. The refrigerant further flows from the oil-separating tube 44 to the external refrigerant circuit 19 and then returns to the motor chamber 121. Lubricating oil is separated from the refrigerant when the refrigerant swirls around the small diameter portion 442. The separated lubricating oil falls into the lower portion of the oil-separating chamber 42. Accordingly, the discharge port 22*e*, the discharge chamber 131, the discharge port 43, and the oil-separating chamber 42 form a discharge pressure region.

An inverter cover 51 made of metal (aluminum in the present embodiment) is fixed to the end wall 12*a* of the motor housing member 12. The inverter cover 51 and the end wall 12*a* of the motor housing member 12 define a chamber that accommodates a motor driving circuit 52 fixed to the outer surface of the end wall 12*a*. Thus, in the present embodiment, the compression unit P, the electric motor M, and the motor driving circuit 52 are arranged in this order in the axial direction of the rotation shaft 20.

The end wall 12*a* of the motor housing member 12 includes a through hole 12*b* that receives a sealing terminal 53. The sealing terminal 53 includes three sets of a metal terminal 54 and a glass insulator 55 (only one set shown in FIG. 1). The metal terminals 54 extend through the motor housing member 12 to electrically connect the electric motor M to the motor driving circuit 52. Each glass insulator 55 fixes the corresponding metal terminal 54 to the end wall 12*a* and insulates the metal terminal 54 from the end wall 12*a*. Each metal terminal 54 has a first end connected to the motor driving circuit 52 by a cable (not shown) and a second end extending into the motor housing member 12.

A resin cluster block 56 is fixed to the outer surface of the stator core 17*a*. The cluster block 56 accommodates three connection terminals 56*a* (only one shown in the FIG. 1). The connection terminals 56*a* electrically connect the leads R to the metal terminals 54. The motor driving circuit 52 supplies power to the coils 17*b* through the metal terminals 54, the connection terminals 56*a*, and the leads R. This integrally rotates the rotor 16 and the rotation shaft 20.

As shown in FIG. 2, an annular sealing member 61, which is in contact with the surface of the rotation shaft 20, divides the insertion hole 21*a* of the shaft support 21 into a back pressure chamber 62 and an accommodating chamber 63. The back pressure chamber 62 is located between the sealing member 61 and the movable scroll 23. The accommodating chamber 63 accommodates the bearing B1. A snap ring 64 is fitted to a section of the insertion hole 21*a* of the shaft support 21 that is located in the back pressure chamber 62. The snap ring 64 restricts movement of the sealing member 61 into the back pressure chamber 62.

The movable scroll 23 includes a first oil passage 65 extending through the movable spiral wall 23*b* and the base plate 23*a* near the center of the movable scroll 23. The first oil passage 65 has an end that opens to the compression chamber 25 and another end that opens to the back pressure chamber 62. Some of the refrigerant compressed in the compression chamber 25 is supplied to the back pressure chamber 62 through the first oil passage 65. The refrigerant supplied to the back pressure chamber 62 flows through the radially inner side of the plate 24 into the circular holes 27*a*. The pressure of the refrigerant supplied into the back pressure chamber 62 and the circular holes 27*a* presses the movable scroll 23 toward the fixed scroll 22. Thus, in the present embodiment, the circular holes 27*a* and the back pressure chamber 62 form a back pressure region located between the movable scroll 23 and the movable member 28 in the motor housing member 12. The back pressure region applies force to the movable scroll 23, and the force presses the movable scroll 23 against the fixed scroll 22.

The rotation shaft 20 includes a first valve chamber 71 extending in the radial direction of the rotation shaft 20. The first valve chamber 71 includes a first hole 71*a*, a small diameter hole 71*b*, which is connected to the first hole 71*a* and has a smaller diameter than the first hole 71*a*, an intermediate diameter hole 71*c*, which is connected to the small diameter hole 71*b* and has a larger diameter than the small diameter hole 71*b*, and a second hole 71*d*, which is connected to the intermediate diameter hole 71*c* and has the substantially same diameter as the first hole 71*a*. A seat 71*g* is formed between the first hole 71*a* and the small diameter hole 71*b*. In addition, a valve seat 71*e* is formed between the second hole 71*d* and the intermediate diameter hole 71*c*. Further, a spring seat 71*f* is formed between the intermediate diameter hole 71*c* and the small diameter hole 71*b*. The second hole 71*d* is connected to the accommodating chamber 63.

The first valve chamber 71 accommodates a centrifugal valve 70. In other words, the rotation shaft 20 includes a centrifugal valve 70. The centrifugal valve 70 includes a mass body 70*w*, which is accommodated in the first hole 71*a*, a first valve body 70*a*, which is accommodated in the second hole 71*d*, a coupling portion 70*b*, which couples the mass body 70*w* to the first valve body 70*a*, and an urging spring 70*c*, which urges the first valve body 70*a* away from the valve seat 71*e*. The urging spring 70*c* is arranged between the spring seat 71*f* and the first valve body 70*a*. The first valve body 70*a* and the coupling portion 70*b* are formed from materials that are lighter than the material forming the mass body 70*w*. The rotation shaft 20 also includes a communication passage 71*h* that extends in the axial direction of the rotation shaft 20 and communicates the back pressure chamber 62 and the small diameter hole 71*b*.

The shaft support 21 includes a second valve chamber 81 extending in the axial direction of the rotation shaft 20. The second valve chamber 81 includes an end that faces toward the end wall 12*a* of the motor housing member 12 and is sealed by a sealing member 81*f*. The shaft support 21 also includes a first communication hole 811 and a second communication hole 812 that communicate the second valve chamber 81 and the pressure-acting void K1 in the annular groove 21*f*. The first communication hole 811 is closer to the end wall 12*a* of the motor housing member 12 than the second communication hole 812. The shaft support 21 also includes a third communication hole 813 that communicates the second valve chamber 81 and the motor chamber 121. The third communication hole 813 faces the first communication hole 811. The second valve chamber 81 also includes an end that faces toward the open end 121*h* of the motor housing member 12 and is in communication with the oil-separating chamber 42 through a second oil passage 68. The second oil passage extends through the shaft support 21, the plate 24, the fixed scroll 22, and the discharge housing member 13.

The second valve chamber 81 accommodates a switching valve 80. The switching valve 80 switches between a state in which the pressure-acting void K1 is in communication with the suction pressure region, which is a low pressure region having a lower pressure than the back pressure region, and a state in which the pressure-acting void K1 is in communication with a discharge pressure region, which is a high pressure area having a higher pressure than the back pressure area. The switching valve 80 includes a second valve body 80*a* and an urging spring 80*b* that is arranged between the second valve body 80*a* and the sealing member 81*f* and urges the second valve body 80*a* away from the sealing member 81*f*. The second valve body 80*a* includes a first valve portion 801*a*, which opens and closes the first communication hole 811, the second communication hole 812, and the third communication hole 813, a second valve portion 801*b*, which opens and closes the second oil passage 68, a receiving portion 801*c*, which receives the urging spring 80*b*, and a coupling portion 801*d*, which couples the first valve portion 801*a* to the receiving portion 801*c*. In addition, the shaft support 21 includes a communication passage 21*k* that communicates the accommodating chamber 63 and an area between the sealing member 81*f* and the receiving portion 801*c* in the second valve chamber 81.

The operation of the first embodiment will now be described.

As shown in FIG. 3, when the rotation speed of the rotation shaft 20 is increased and the rotation shaft 20 rotates at a high speed in the compressor 10, centrifugal force moves the mass body 70*w* of the centrifugal valve 70 away from the seat 71*g*. The centrifugal force acting on the mass body 70*w* prevails over the urging force of the urging spring 70*c* so that the valve body 70*a* is seated on the valve seat 71*e*. In this case, the communication passage 71*h*, the small diameter hole 71*b*, the intermediate diameter hole 71*c*, the second hole 71*d*, the accommodating chamber 63, and the communication passage 21*k* no longer communicate the back pressure chamber 62 with the area between the receiving portion 801*c* and the sealing member 81*f* in the second valve chamber 81.

Here, the area between the receiving portion 801*c* and the sealing member 81*f* is in communication with the motor chamber 121 through the communication passage 21*k*, the accommodating chamber 63, and the gap between the shaft support 21 and the rotation shaft 20. Thus, the refrigerant in the space between the receiving portion 801*c* and the sealing member 81*f* flows to the motor chamber 121 through the communication passage 21*k*, the accommodating chamber 63, and the gap between the shaft support 21 and the rotation shaft 20. Consequently, the area between the receiving portion 801*c* and the sealing member 81*f* becomes part of the suction pressure region.

The pressure of the lubricating oil flowing from the oil-separating chamber 42 to the second valve chamber 81 through the second oil passage 68 prevails over the urging force of the urging spring 80*b* and the pressure in the area between the receiving portion 801*c* and the sealing member 81*f*. This presses the second valve body 80*a* toward the end wall 12*a* of the motor housing member 12. Consequently, the second valve portion 801*b* opens the second oil passage 68, and the first valve portion 801*a* opens the second communication hole 812. This allows the lubricating oil in the second oil passage 68 to flow into the pressure-acting void K1 through the second valve chamber 81 and the second communication hole 812. Consequently, the pressure-acting void K1 becomes part of the discharge pressure region.

Then, the difference between the pressure in the back pressure chamber 62 and the pressure in the pressure-acting void K1 moves the movable member 28 toward the open end 121*h* of the motor housing member 12 (in a first direction along the axis of the rotation shaft 20). Accordingly, the area of contact between each cylindrical pin 27*b* and the wall of the corresponding circular hole 27*a* moves from the small diameter portion 271*d* to the step portion 273*b* and then to the large diameter portion 272*b*. This reduces the orbital radius of the cylindrical pins 27*b* relative to the corresponding circular holes 27*a*. As a result, the orbit radius of the movable scroll 23 is decreased compared to when the area of contact between each cylindrical pin 27*b* and the wall of the corresponding circular hole 27*a* is the small diameter portion 271*b*. Thus, the movable spiral wall 23*b* moves out of contact with the fixed spiral wall 22*c* when the rotation shaft 20 rotates at a high speed. This reduces noise that would be caused by contact between the fixed spiral wall 22*c* and the movable spiral wall 23*b* during the high-speed rotation.

As shown in FIG. 2, when the rotation speed of the rotation shaft 20 is decreased and the rotation shaft 20 rotates at a low speed in the compressor 10, centrifugal force keeps the mass body 70*w* seated on the seat 71*g*. Thus, the valve body 70*a* is spaced apart from the valve seat 71*e* by the urging force of the urging spring 70*c*. This allows the refrigerant in the back pressure chamber 62 to flow through the communication passage 71*h*, the small diameter hole 71*b*, the intermediate diameter hole 71*c*, the second hole 71*d*, the accommodating chamber 63 and the communication passage 21*k* into the area between the receiving portion 801*c* and the sealing member 81*f*. Consequently, the space between the receiving portion 801*c* and the sealing member 81*f* becomes part of the back pressure region.

The pressure of the refrigerant flowing into the area between the receiving portion 801*c* and the sealing member 81*f* in the second valve chamber 81 and the urging force of the urging spring 80*b* prevail over the pressure of the lubricating oil flowing into the second valve chamber 81 from the oil-separating chamber 42 through the second oil passage 68. This moves the second valve body 80*a* toward the open end 121*h* of the motor housing member 12. In this case, the first valve portion 801*a* opens the first communication hole 811 and the third communication hole 813 and closes the second communication hole 812. Further, the second valve portion 801*b* closes the second oil passage 68. This allows the refrigerant in the pressure-acting void K1 to flow into the motor chamber 121 through the first communication hole 811, the second valve chamber 81, and the third communication hole 813. Consequently, the pressure-acting void K1 becomes part of the suction pressure region.

Then, the difference between the pressure in the back pressure chamber 62 and the pressure in the pressure-acting void K1 moves the movable member 28 toward the end wall 12*a* of the motor housing member 12 (in a second direction that is opposite from the first direction). Accordingly, the area of contact between each cylindrical pin 27*b* and the wall of the corresponding circular hole 27*a* moves from the large diameter portion 272*d* to the step portion 273*b* and then to the small diameter portion 271*b*. This increases the orbital radius of the cylindrical pins 27*b* relative to the corresponding circular holes 27*a*. As a result, the orbit radius of the movable scroll 23 is increased compared to when the area of contact between each cylindrical pin 27*b* and the wall of the corresponding circular hole 27*a* is the large diameter portion 272*b*. Thus, the movable spiral wall 23*b* moves into contact with the fixed spiral wall 22*c* when the rotation shaft 20 rotates at a low speed. This reduces leakage of refrigerant from the compression chamber 25 during the low-speed rotation.

Accordingly, the centrifugal valve 70 controls actuation of the switching valve 80 so that the pressure-acting void K1 comes into communication with the discharge pressure region when an increase in the rotation speed of the rotation shaft 20 increases the centrifugal force. Further, the centrifugal valve 70 controls actuation of the switching valve 80 so that the pressure-acting void K1 comes into communication with the suction pressure region when a decrease in the rotation speed of the rotation shaft 20 reduces the centrifugal force. In the present embodiment, the centrifugal valve 70 and the switching valve 80 form an orbital radius switching mechanism. The orbital radius of the movable scroll 23 is increased or decreased when the bushing 20*b* slides or swings to move in the radial direction relative to the eccentric shaft 20*a* and thereby permit movement of the movable scroll 23 in the radial direction.

The advantage of the first embodiment will now be described.

(1) Each cylindrical pin 27*b* includes the small diameter portion 271*b* and the large diameter portion 272*b* that has a larger diameter than the small diameter portion 271*b*. When the rotation speed of the rotation shaft 20 is increased, the centrifugal valve 70 and the switching valve 80 move the movable member 28 in the first direction along the axis of the rotation shaft 20.

This reduces the orbital radius of the cylindrical pin 27*b* relative to the corresponding circular hole 27*a* and the orbital radius of the movable scroll 23. Thus, the movable spiral wall 23*b* is not in contact with the fixed spiral wall 22*c* when the rotation shaft is rotating at a high speed. This reduces noise that would be caused by contact between the fixed spiral wall 22*c* and the movable spiral wall 23*b* during the high-speed rotation. Additionally, when the rotation speed of the rotation shaft 20 is decreased, the centrifugal valve 70 and the switching valve 80 move the movable member 28 in the second direction that is opposite from the first direction. This increases the orbital radius of the cylindrical pin 27*b* relative to the circular hole 27*a* and the orbital radius of the movable scroll 23. Thus, the movable spiral wall 23*b* is in contact with the fixed spiral wall 22*c* when the rotation shaft is rotating at a low speed. This suppresses leakage of refrigerant from the compression chamber 25 during the low-speed rotation.

(2) The centrifugal valve 70 and the switching valve 80 form the orbital radius switching mechanism. Thus, the centrifugal valve 70, which uses the centrifugal force produced in accordance with the increase and decrease in the rotation speed of the rotation shaft 20, controls actuation of the switching valve 80, which switches between a state in which the pressure-acting void K1 is in communication with the suction pressure region and a state in which the pressure-acting void K1 is in communication with the discharge pressure region. This eliminates the need for electric control that involves detection of an increase and decrease in the rotation speed of the rotation shaft 20 and control of actuation of the switching valve 80 based on the detection results, for example. Thus, the actuation control of the switching valve 80 is simplified.

(3) The centrifugal valve 70 is included in the rotation shaft 20. This ensures that the centrifugal valve 70 receives the centrifugal force produced in accordance with an increase and decrease of the rotation speed of the rotation shaft 20. Thus, the actuation control of the switching valve 80 is performed in a preferable manner.

(4) The cylindrical pins 27*b* are integrated with the movable member 28. This simplifies the structure compared to a structure in which the shaft support 21 includes grooves at positions corresponding to cylindrical pins 27*b* and each of the grooves accommodates a member arranged between the corresponding cylindrical pin 27*b* and the shaft support 21 and moved as a movable member.

(5) The cylindrical pin 27*b* includes the small diameter portion 271*b* and the large diameter portion 272*b*. This simplifies the arrangement of the small diameter portion 271*b* and the large diameter portion 272*b* compared to a structure in which the circular hole 27*a* includes a small diameter portion and a large diameter portion.

Second Embodiment

Figure 4:
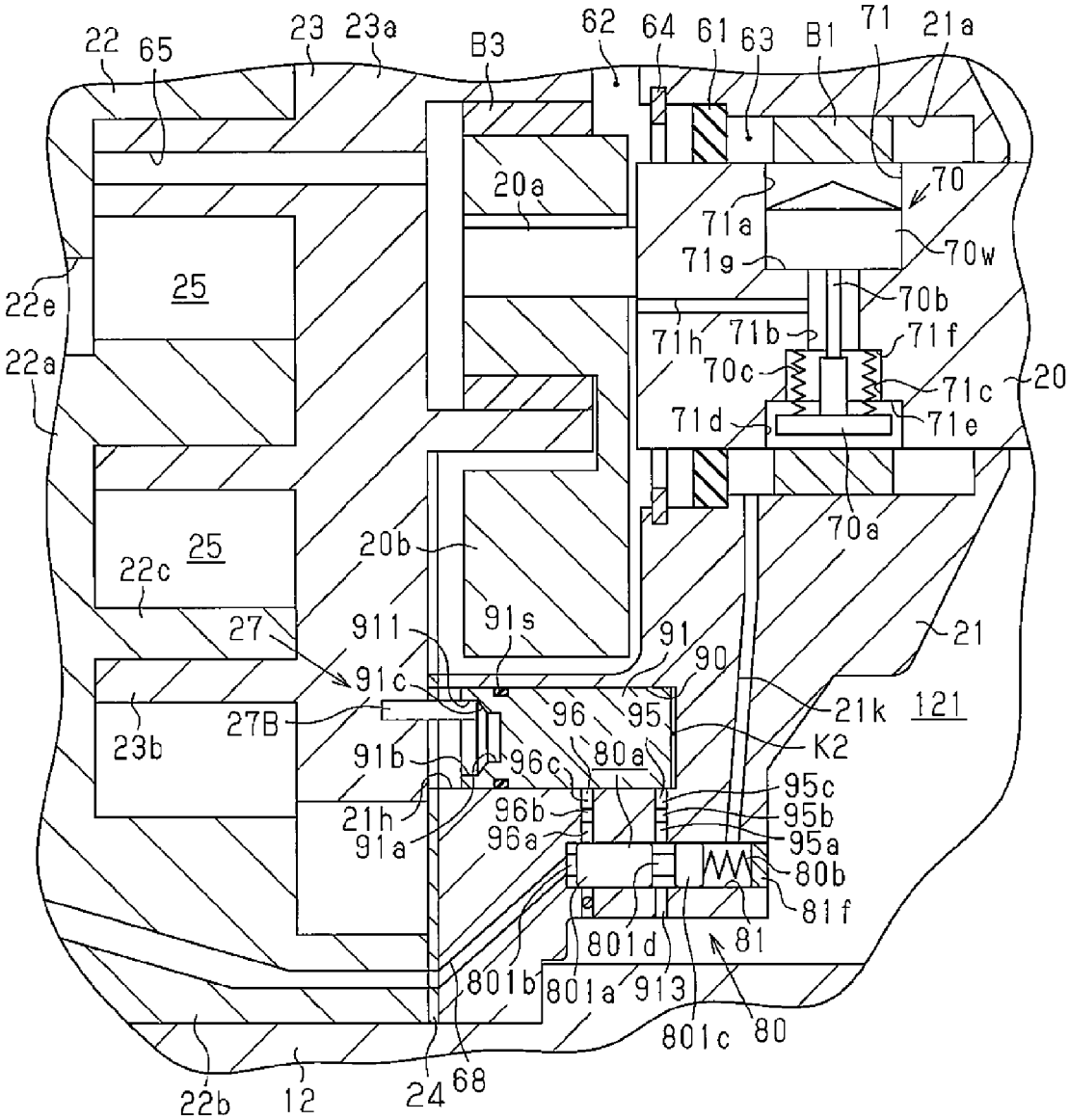
FIG. 4 is an enlarged cross-sectional view showing an rotation restriction mechanism of a second embodiment.
Figure 5:
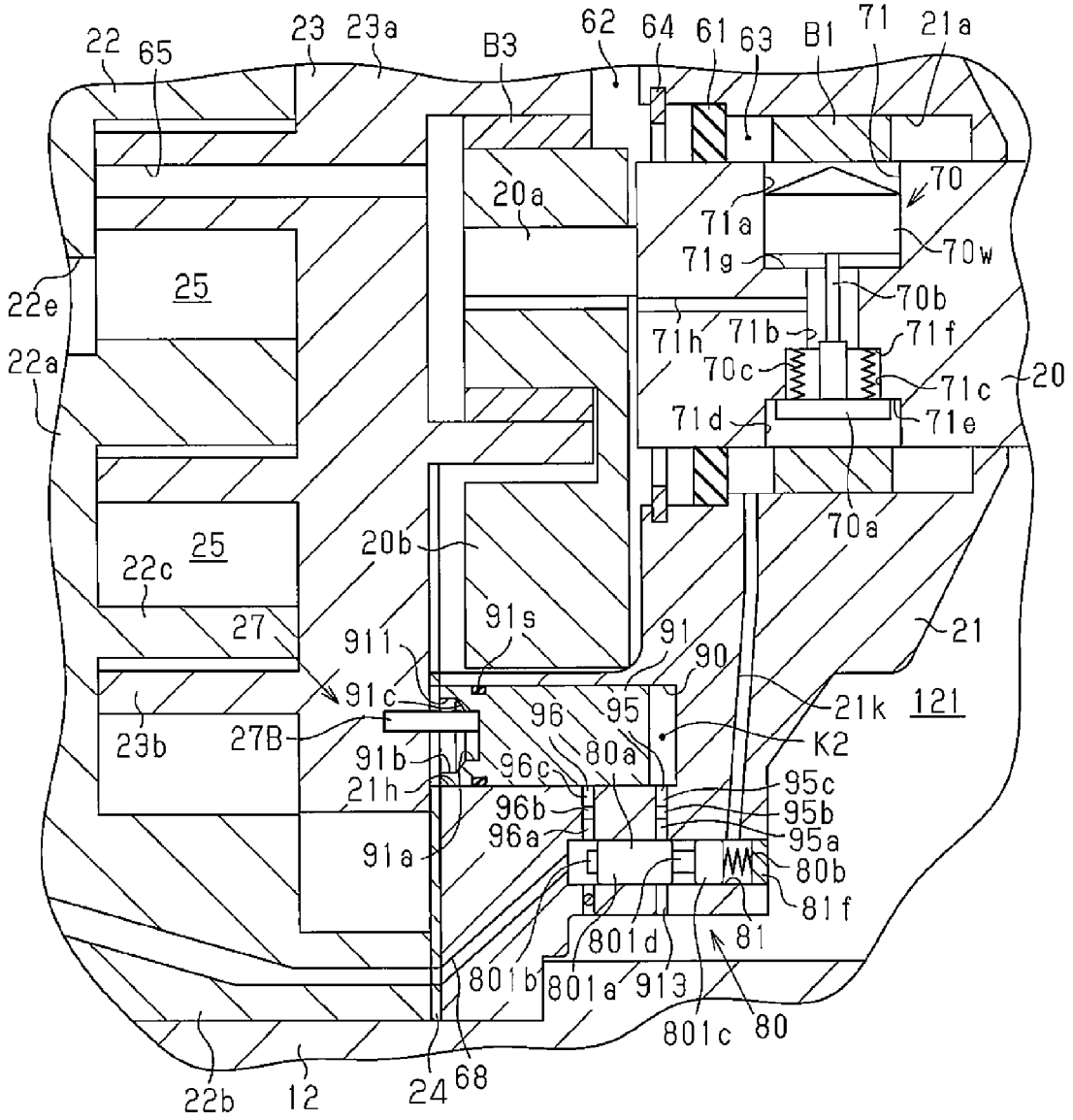
FIG. 5 is an enlarged cross-sectional view showing the rotation restriction mechanism of the second embodiment.

Referring to FIGS. 4 and 5, a second embodiment will now be described. Same reference numerals are given to those components that are the same as the corresponding components of the first embodiment. Such components will not be described in detail.

As shown in FIG. 4, a plurality of cylindrical pins 27B (only one shown in FIG. 4) project from the end surface of the movable scroll 23 that faces toward the shaft support 21. The end surface of the shaft support 21 that faces toward the movable scroll 23 includes grooves 90 located at positions corresponding to the cylindrical pins 27B. Each groove 90 accommodates a spacer 91. The spacers 91 are movable in the corresponding grooves 90 in the axial direction of the rotation shaft 20. Thus, in the present embodiment, the spacers 91 function as movable members.

Each spacer 91 includes a circular hole 911. The circular hole 911 includes a small diameter portion 91*a*, a large diameter portion 91*b*, which has a larger diameter than the small diameter portion 91*a*, and a step portion 91*c*, which is located between the small diameter portion 91*a* and the large diameter portion 91*b*. The large diameter portion 91*b* is closer to the open end of the circular hole 911 than the small diameter portion 91*a*. The step portion 91*c* extends linearly and is diagonal in the cross section to the axis of the rotation shaft 20 so as to form a part of conical surface. The spacers 91 are arranged between the cylindrical pins 27B and the shaft support 21 and prevent direct contact and friction between the cylindrical pins 27B and the shaft support 21.

Each spacer 91 has an outer surface including an annular sealing member 91*s*. The sealing member 91*s* seals a pressure-acting void K2, which extends in the groove 90 from the sealing member 91*s* toward the end wall 12*a* of the motor housing member 12, from the area in the groove 90 that is in communication with the back pressure chamber 62. The pressure-acting void K2 is formed between the spacer 91 and the shaft support 21.

The shaft support 21 includes a first communication flow passage 95 and a second communication flow passage 96 that communicate the second valve chamber 81 and the pressure-acting void K2 in each groove 90. The first communication flow passage 95 is closer to the end wall 12*a* of the motor housing member 12 than the second communication flow passage 96. The shaft support 21 also includes a third communication hole 913 communicating the second valve chamber 81 and the motor chamber 121. The third communication hole 913 faces the first communication flow passage 95.

The first communication flow passage 95 includes a first flow passage 95*a*, a first annular flow passage 95*b*, and a first passage 95*c*. The first flow passage 95*a* is in communication with the second valve chamber 81. The first annular flow passage 95*b* is in communication with the first flow passage 95*a* and surround the grooves 90. The first passage 95*c* is in communication with the first annular flow passage 95*b* and is arranged for each groove 90. The second communication flow passage 96 includes a second flow passage 96*a*, a second annular flow passage 96*b*, and a second passage 96*c*. The second flow passage 96*a* is in communication with the second valve chamber 81. The second annular flow passage 96*b* is in communication with the second flow passage 96*a* and surrounds the grooves 90. The second passage 96*c* is in communication with the second annular flow passage 96*b* and is arranged for each groove 90.

The operation of the second embodiment will now be described.

As shown in FIG. 5, when the rotation speed of the rotation shaft 20 is increased and the rotation shaft 20 rotates at a high speed in the compressor 10, centrifugal force moves the mass body 70*w* of the centrifugal valve 70 away from the seat 71*g*. The centrifugal force acting on the mass body 70*w* prevails over the urging force of the urging spring 70*c* and seats the valve body 70*a* on the valve seat 71*e*. In this case, the communication passage 71*h*, the small diameter hole 71*b*, the intermediate diameter hole 71*c*, the second hole 71*d*, the accommodating chamber 63, and the communication passage 21*k* no longer communicate the back pressure chamber 62 and the area between the receiving portion 801*c* and the sealing member 81*f* in the second valve chamber 81.

Here, the area between the receiving portion 801*c* and the sealing member 81*f* is in communication with the motor chamber 121 through the communication passage 21*k*, the accommodating chamber 63, and the gap between the shaft support 21 and the rotation shaft 20. Thus, the refrigerant in the space between the receiving portion 801*c* and the sealing member 81*f* flows to the motor chamber 121 through the communication passage 21*k*, the accommodating chamber 63, and the gap between the shaft support 21 and the rotation shaft 20. Consequently, the area between the receiving portion 801*c* and the sealing member 81*f* becomes part of the suction pressure region.

The pressure of the lubricating oil flowing from the oil-separating chamber 42 to the second valve chamber 81 through the second oil passage 68 prevails over the urging force of the urging spring 80*b* and the pressure in the space between the receiving portion 801*c* and the sealing member 81*f* and presses the second valve body 80*a* toward the end wall 12*a* of the motor housing member 12. Then, the second valve portion 801*b* opens the second oil passage 68, and the first valve portion 801*a* opens the second communication flow passage 96. This allows the lubricating oil in the second oil passage 68 to flow into each of the pressure-acting voids K2 through the second valve chamber 81, the second flow passage 96*a*, the second annular flow passage 96*b*, and the second passage 96*c*. Consequently, the pressure-acting voids K2 become parts of the discharge pressure region.

Then, the difference between the pressure in the back pressure chamber 62 and the pressure in the pressure-acting voids K2 moves the spacers 91 toward the open end 121*h* of the motor housing member 12 (in a first direction along the axis of the rotation shaft 20). Accordingly, the area of contact between each cylindrical pin 27B and the wall of the circular hole 911 in the corresponding spacer 91 moves from the large diameter portion 91*b* to the step portion 91*c* and then to the small diameter portion 91*a*. This reduces the orbital radius of the cylindrical pin 27B relative to the circular hole 911. As a result, the orbital radius of the movable scroll 23 is decreased compared to when the area of contact between each cylindrical pin 27B and the wall of the circular hole 911 in the corresponding spacer 91 is the large diameter portion 91*b*. Thus, the movable spiral wall 23*b* is not in contact with the fixed spiral wall 22*c* when the rotation shaft 20 rotates at a high speed. This reduces noise that would be caused by contact between the fixed spiral wall 22*c* and the movable spiral wall 23*b* during the high-speed rotation.

As shown in FIG. 4, when the rotation speed of the rotation shaft 20 is decreased and the rotation shaft 20 rotates at a low speed in the compressor 10, the mass body 70*w* of the centrifugal valve 70 is not separated from the seat 71*g* by centrifugal force and remains seated on the seat 71*g*. Thus, the valve body 70*a* is spaced apart from the valve seat 71*e* by the urging force of the urging spring 70*c*. This allows the refrigerant in the back pressure chamber 62 to flow through the communication passage 71*h*, the small diameter hole 71*b*, the intermediate diameter hole 71*c*, the second hole 71*d*, the accommodating chamber 63, and the communication passage 21*k* into the area between the receiving portion 801*c* and the sealing member 81*f*. Consequently, the area between the receiving portion 801*c* and the sealing member 81*f* becomes part of the back pressure region.

The pressure of the refrigerant flowing into the area between the receiving portion 801*c* and the sealing member 81*f* in the second valve chamber 81 and the urging force of the urging spring 80*b* prevail over the pressure of the lubricating oil flowing from the oil-separating chamber 42 to the second valve chamber 81 through the second oil passage 68 and move the second valve body 80*a* toward the open end 121*h* of the motor housing member 12. Then, the first valve portion 801*a* opens the first communication flow passage 95 and the third communication hole 913 and closes the second communication flow passage 96. Further, the second valve portion 801*b* closes the second oil passage 68. This allows the refrigerant in the pressure-acting voids K2 to flow into the motor chamber 121 through the first passage 95*c*, the first annular flow passage 95*b*, the first flow passage 95*a*, the second valve chamber 81, and the third communication hole 913. Consequently, the pressure-acting voids K2 form parts of the suction pressure region.

Then, the difference between the pressure in the back pressure chamber 62 and the pressure in the pressure-acting voids K2 moves the spacers 91 toward the end wall 12*a* of the motor housing member 12 (in a second direction that is opposite from the first direction). Accordingly, the area of contact between each cylindrical pin 27B and the wall of the circular hole 911 in the corresponding spacer 91 moves from the small diameter portion 91*a* to the step portion 91*c* and then to the large diameter portion 91*b*. This increases the orbital radius of the cylindrical pins 27B relative to the respective circular holes 911. As a result, the orbital radius of the movable scroll 23 is increased compared to when the area of contact between each cylindrical pin 27B and the wall of the circular hole 911 in the corresponding spacer 91 is in the small diameter portion 91*a*. Thus, the movable spiral wall 23*b* is in contact with the fixed spiral wall 22*c* when the rotation shaft 20 rotates at a low speed. This reduces leakage of refrigerant from the compression chamber 25 during the low-speed operation.

Accordingly, the second embodiment has the following advantages in addition to advantages (1) to (3) of the first embodiment.

(6) The spacers 91 are moved in the axial direction of the rotation shaft 20. The spacers 91 are conventional members arranged to suppress friction between the cylindrical pins 27B and the shaft support 21. The use of these conventional spacers 91 as the movable members eliminates the need for forming additional movable members and simplifies the structure.

(7) The circular hole 911 of each spacer 91 includes the small diameter portion 91*a* and the large diameter portion 91*b*. This allows for smooth changes in the orbital radius of the cylindrical pins 27B relative to the respective circular holes 911 as compared to a structure in which a small diameter portion and a large diameter portion are arranged in the cylindrical pin 27B.

It should be apparent to those skilled in the art that the present invention may be embodied in many other specific forms without departing from the spirit or scope of the invention. Particularly, it should be understood that the present invention may be embodied in the following forms.

In the first embodiment, the circular hole 27*a* may include a small diameter portion and a large diameter portion. Any structure may be employed as long as at least either of the cylindrical pins 27*b* and the circular holes 27*a* each include a small diameter portion and a large diameter portion.

The first embodiment performs a two-step switching of the orbital radius by arranging the small diameter portion 271*b* and the large diameter portion 272*b* in the cylindrical pin 27*b*. However, an intermediate diameter portion may be arranged between the small diameter portion 271*b* and the large diameter portion 272*b* to perform switching between three or more steps.

In the second embodiment, the cylindrical pin 27B may include a small diameter portion and a large diameter portion. Any structure may be employed as long as at least either of the cylindrical pins 27*b* and the circular holes 911 of the spacers 91 each include a small diameter portion and a large diameter portion.

The second embodiment performs a two-step switching of the orbital radius by arranging the small diameter portion 91*a* and the large diameter portion 91*b* in the circular holes 911 of the spacer 91. However, an intermediate diameter portion may be arranged between the small diameter portion 91*a* and the large diameter portion 91*b* to perform switching between three or more steps.

In the second embodiment, not all the spacers 91 have to include a small diameter portion and a large diameter portion.

The step portions 273*b* and 91*c* may be arcuate in the cross section.

The centrifugal valve 70 may be arranged at any position where the centrifugal valve 70 can receive centrifugal force corresponding to increase and decrease in the rotation speed of the rotation shaft 20.

In the above embodiments, an increase and decrease in the rotation speed of the rotation shaft 20, for example, may be detected, and actuation of the switching valve 80 may be controlled based on the detection results.

The pressure-acting voids K1 and K2 do not have to be in communication with the suction pressure region or the discharge pressure region as long as the pressure-acting voids K1 and K2 are in communication with a low pressure region that has a lower pressure than the back pressure region or a high pressure region that has a higher pressure than the back pressure region.

The bushing 20*b* may be fixed to the eccentric shaft 20*a*, and the radial movement of the movable scroll 23 may be permitted by a gap between the movable scroll 23 and the bearing B3 or a gap between the bushing 20*b* and the bearing B3.

In the above embodiments, the second valve chamber 81 receives lubricating oil from the oil-separating chamber 42 through the second oil passage 68. However, the second valve chamber 81 may be in communication with the discharge chamber 131 so that refrigerant having the discharge pressure is delivered to the second valve chamber 81.

The present invention may be embodied in a scroll compressor that is directly driven by a driving source such as an engine, instead of being driven by the electric motor M.

The present examples and embodiments are to be considered as illustrative and not restrictive and the invention is not to be limited to the details given herein, but may be modified within the scope and equivalence of the appended claims.

The invention claimed is:

1. A scroll compressor comprising:

a rotation shaft;

a fixed scroll including a fixed spiral wall;

a movable scroll including a movable spiral wall engaged with the fixed spiral wall, wherein the movable scroll orbits when the rotation shaft is rotated;

a compression chamber defined between the fixed spiral wall and the movable spiral wall, wherein the compression chamber has a volume that is decreased when the movable scroll orbits, and refrigerant is compressed in the compression chamber when the volume is decreased;

a shaft support that supports the rotation shaft, wherein the shaft support and the fixed scroll are arranged at opposite sides of the movable scroll;

a housing that accommodates the rotation shaft, the fixed scroll, the movable scroll, and the shaft support;

a movable member arranged in the shaft support and configured to be movable in an axial direction of the rotation shaft toward and away from the movable scroll;

a rotation restriction mechanism configured to restrict rotation of the movable scroll, wherein the rotation restriction mechanism includes a cylindrical pin, which is arranged in one of the movable scroll and the movable member, and a circular hole, which is arranged in the other of the movable scroll and the movable member, the cylindrical pin is loosely fitted into the circular hole, and at least one of the cylindrical pin and the circular hole includes a small diameter portion and a large diameter portion; and an orbital radius switching mechanism configured to move the movable member in a first direction along an axis of the rotation shaft when a rotation speed of the rotation shaft is increased, which decreases an orbital radius of the cylindrical pin relative to the circular hole so that an orbital radius of the movable scroll is decreased, and configured to move the movable member in a second direction, which is opposite to the first direction, when the rotation speed of the rotation shaft is decreased, which increases the orbital radius of the cylindrical pin relative to the circular hole so that the orbital radius of the movable scroll is increased.

2. The scroll compressor according to claim 1, further comprising:

a back pressure region arranged in the housing and configured to apply force to the movable scroll so that the movable scroll is pressed against the fixed scroll; and a pressure-acting void formed between the movable member and the shaft support, wherein the orbital radius switching mechanism includes a switching valve that switches between a state in which the pressure-acting void is in communication with a low pressure region, the pressure of which is lower than that of the back pressure region, and a state in which the pressure-acting void is in communication with a high pressure region, the pressure of which is higher than that of the back pressure region, and a centrifugal valve configured to control actuation of the switching valve so that the pressure-acting void comes into communication with the high pressure region when a centrifugal force is increased by an increase in the rotation speed of the rotation shaft and the pressure-acting void comes into communication with the low pressure region when the centrifugal force is decreased by a decrease in the rotation speed of the rotation shaft.

3. The scroll compressor according to claim 2, wherein the rotation shaft includes the centrifugal valve.

4. The scroll compressor according to claim 1, wherein the cylindrical pin is integral with the movable member.

5. The scroll compressor according to claim 4, wherein the cylindrical pin includes the small diameter portion and the large diameter portion.

6. The scroll compressor according to claim 1, wherein the shaft support includes a groove at a position corresponding to the cylindrical pin, the movable member is a spacer arranged in the groove between the cylindrical pin and the shaft support, and the spacer includes the circular hole.

7. The scroll compressor according to claim 6, wherein the circular hole includes the small diameter portion and the large diameter portion.

* * * * *